US005197926A

United States Patent [19]

Cunard

[11] Patent Number: 5,197,926

[45] Date of Patent: Mar. 30, 1993

[54] SWING CONNECTION GUARD

[75] Inventor: Joel C. Cunard, Bedford, Pa.

[73] Assignee: Hedstrom Corporation, Bedford, Pa.

[21] Appl. No.: 838,878

[22] Filed: Feb. 18, 1992

[51] Int. Cl.[5] ..... A63G 9/04

[52] U.S. Cl. ..... 472/118; 403/23; 403/128

[58] Field of Search ..... 472/118, 120, 122, 123; 403/23, 128

[56] References Cited

U.S. PATENT DOCUMENTS

| | | | |
|---|---|---|---|
| 821,829 | 5/1906 | Porter | 403/23 |
| 921,833 | 5/1909 | Hespe et al. | 403/128 |
| 1,955,450 | 4/1934 | Blackburn | 403/23 |
| 2,119,434 | 5/1938 | Henken | 403/23 |
| 2,678,841 | 5/1954 | Klages | 403/128 |
| 3,897,056 | 1/1975 | Hock et al. | 472/118 |
| 4,478,410 | 10/1984 | Ziegler, Jr. | 472/118 |
| 5,163,828 | 11/1992 | Coddington, Jr. | 472/118 |

*Primary Examiner*—Richard E. Chilcot, Jr.
*Assistant Examiner*—Kien Nguyen
*Attorney, Agent, or Firm*—Cesari and McKenna

[57] ABSTRACT

A guard for a swing connection comprised of a hook which hooks through the eye of a connector member includes a pair of rigid shells which are slotted at their edges to provide clearance for the hook and the connector member so that the shells can be clamped to opposite sides of the hook and engaged together edge to edge so as to form an enclosure which completely surrounds the hook and its connection to the connector member. The guard prevents finger injuries due to the pinch point at the connection between the hook and the connector member. It also maintains the relative position of the hook and connector member so that the connector member cannot become disengaged accidentally from the hook. In addition, the guard may be shaped and its exterior surface treated so that the guard adds a decorative element to the swing connection.

21 Claims, 2 Drawing Sheets

SWING CONNECTION GUARD

This invention relates to a children's swing. It relates more particularly to a protective guard for shielding a child's fingers from pinch points at various connections to the swing and for preventing accidental release of those connections.

BACKGROUND OF THE INVENTION

Many gym sets in use today include a swing whose seat, instead of being a rigid platform, is a flexible strap which, when suspended by chains from the crossbar of the gym set, forms a swing in which the child can sit comfortably. Such a flexible swing seat has an advantage because if a moving seat happens to strike a child, the impact will not cause serious injury to the child. Also, a sling-type seat conforms to the rider's body and tends to retain the rider on the seat. Still further, the seat is usually more comfortable than a rigid platform-type seat.

The usual sling-type swing seat includes a flexible rectangular strap having a pair of inextensible, flexible connector members, such as metal strips or chains captured by the strap adjacent to the front and rear edges thereof and extending the full length of the strap. A pair of rigid wire hangers are anchored to corresponding ends of those members at opposite ends of the strap. The hangers have end hooks which hook through eyes or links at the ends of the connector members. The hangers are then suspended by chains from an overhead cross bar or other support to position the seat above the ground. For this, the links at the upper ends of the chains are connected by hooks to bearing assemblies anchored to the overhead support. An example of such a seat is disclosed in U.S. Pat. No. 3,897,056.

Conventional flexible swing seats are disadvantaged, however, in that they still present some danger to children because the connections between the hangers and the inextensible members extending along the strap-like seat are more or less exposed and constitute pinch points which can injure the fingers of a child sitting on the seat. Similar pinch points exist where the upper ends of the chains are connected by S-hooks to the overhead support and these connections are also accessible to a child who happens to swing while standing on the seat.

A somewhat similar seat disclosed in U.S. Pat. No. 4,478,410 avoids the need for separate connector members in the seat and separate wire hangers by routing the seat suspension chains through integral tubes in the seat strap. An S-hook connects the free lower end of each chain to the opposite chain just above the seat so that the chains themselves form the seat hangers. In this type of seat, pinch points are located at the S-hooks which connect the chains together just above the seat.

Another problem with swings of this type as well as with swings in general which use hooks as connectors, stems from the fact that the hooks are not always closed completely about the chain link, ring or other eye-forming member to which they are connected. Accordingly, when the swing is in motion, an unclosed hook can disengage accidently from the eye-forming member causing one side of the swing to collapse. Obviously such collapse can cause serious injury to the child swinging on the swing. Swing failure due to incomplete closure of connector hooks is particularly prevalent in the case of swing sets assembled by the customers because the customers frequently fail to follow the instructions accompanying the swing sets.

SUMMARY OF THE INVENTION

Accordingly it is an object of the present invention to provide a swing construction which minimizes the likelihood of a child being injured while using the swing.

Another object of the invention is to provide a swing construction having no exposed pinch points.

A further object to the invention is to provide a protective guard member for enclosing pinch points at various connections on a children's swing.

Another object of the invention is to provide a guard member for enclosing such swing connections which prevents accidental release of the connections.

Yet another object of the invention is to provide a guard member of this type which is relatively easy and inexpensive to make in quantity.

A further object of the invention is to provide swing connection guards which add an element of ornamentation to the swings.

Still another object of the invention is to provide a connection guard for a children's swing which can be retrofitted easily to existing swings.

Other objects will, in part, be obvious and, will, in part, appear hereinafter. The invention accordingly comprises the features of construction, combination of element and arrangement of parts which will be exemplified in the following detailed description, and the scope of the invention will be indicated in the claims.

Briefly, the swings on which my connection guards are installed preferably comprise a generally rectangular, flexible, strap-like seat. Extending along the seat adjacent to the front and rear or longitudinal edges thereof are a pair of flexible inextensible connector members. A pair of inverted V-shaped hangers at the opposite ends of the seat have arms which terminate as hooks and are hooked through rings or eyes at the opposite ends of the connector members. The seat is suspended above the ground by suspension chains whose lower end links receive the bases of the V-shaped hangers and whose upper ends are hooked to a suitable overhead support, such as the bearing units mounted to the crossbar of a play gym.

In accordance with this invention, relatively stiff or rigid connection guards cover the hanger hooks at the opposite ends of the swing seat and the connections of those hooks to the connector members extending along the seat. Resultantly, there is no possibility of a child's finger being caught or pinched at those locations. As we shall see, the guards also prevent the accidental release of the hooks from the connector members in the event that the hooks were not clinched or closed completely when installed. Similar rigid connection guards are present at the opposite or upper ends of the swing suspension chains where those ends are hooked to the bearing units suspended from the overhead support.

Each connection guard comprises a pair of more or less mirror-image shells which mate at their edges to form a complete enclosure. The two shells are arranged to be engaged to opposite sides of a hanger hook and notches are formed in the edge of at least one shell to provide clearance for the hanger arm leading to the hook and for the connector member attached thereto. The two shells are releasebly secured together by a fastener which extends through a wall of one of the shells and the associated hanger hook and is anchored to a wall of the other shell. When the two shells are secured together thusly, they completely enclose the hanger hook and its connection to the associated connector member.

As will be described in more detail later, the two shells are formed with internal pedestals which, when the shelves are mated, form an axle which extends through the hanger hook. This axle, along with the notches which capture the associated hanger arm and connector member prevent the connector member from moving to the mouth of the hook and escaping in the event that the hook is not completely closed, i.e., has an open mouth.

In addition to providing the safety features just described, the connection guards at the opposite ends of the swing seat and at the upper ends of the swing suspension chains also add an element of decoration to the swing by virtue of their shapes, which is desirable from a marketing standpoint. The guards may also be provided with brightly colored outer coatings or given some other surface treatment to enhance their appearance and thus the overall appearance of the swing.

The shells comprising the connection guards are relatively simple parts which can be molded of any suitable plastic material. Therefore, they are relatively inexpensive to make in quantity. Also, the guards are quite easy to install. Consequently, such installation can be left to the purchaser of the swing. The guards can even be sold seperately and be retrofitted to existing swings to make those swing more safe.

BRIEF DESCRIPTION OF THE DRAWINGS

For fuller understanding of the nature and objects of the invention, reference should be had to the following detailed description, taken in connection with the accompanying drawings, in which.

DESCRIPTION OF THE PREFERRED EMBODIMENT

Figure 1:
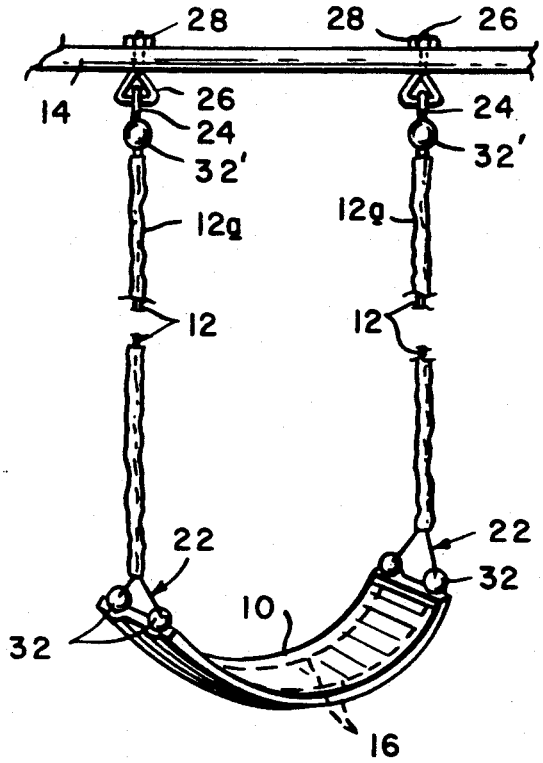
FIG. 1 is a fragmentary isometric view of a swing incorporating connection guards made according to this invention.
Figure 3:
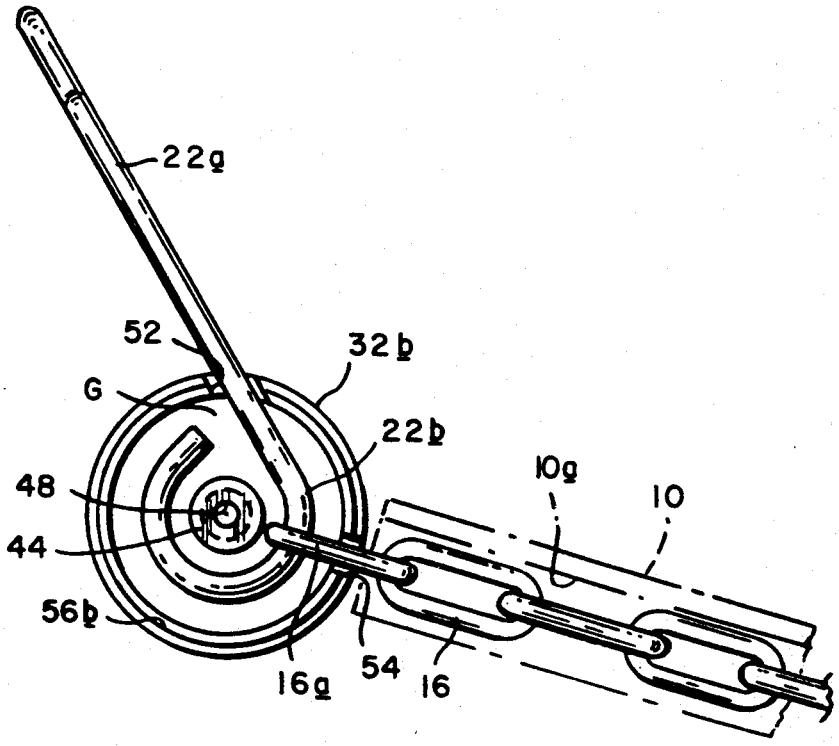
FIG. 3 is a view taken along line 3—3 of FIG. 2.
Figure 2:
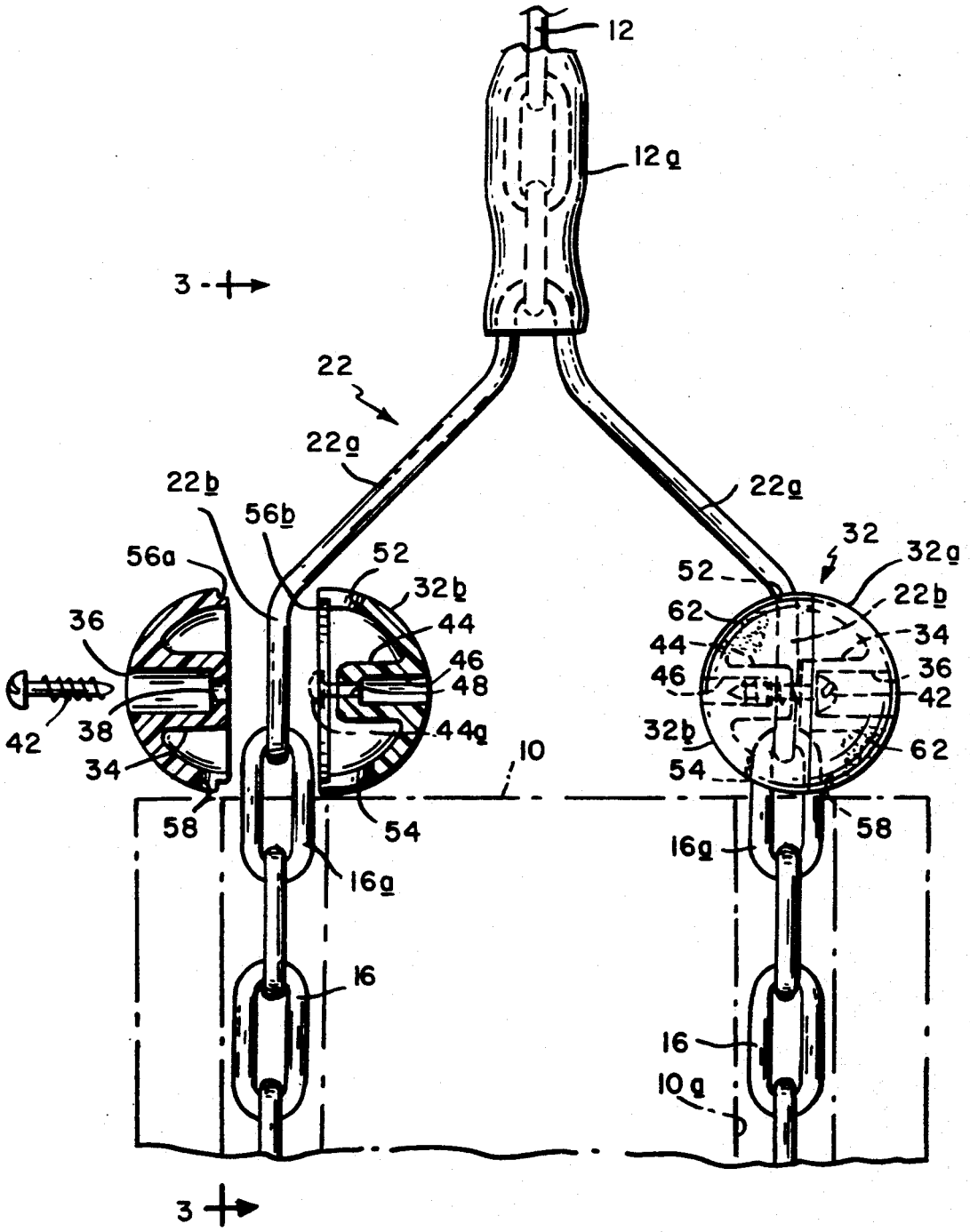
FIG. 2 is a side view, partially exploded and on a much larger scale, showing the connection guards in greater detail.

Referring to FIG. 1 of the drawings, a swing incorporating my invention includes a flexible swing seat 10 which is suspended by chains 12 from an overhead support such as the crossbar 14 of the gym set (not shown). Extending along the length of seat 10 adjacent to the front and rear edges thereof is a pair of flexible inextensible connector members 16. The connector members may be metal straps as described, for example, in U.S. Pat. No. 3,897,056. Alternatively and more preferably, they are short lengths of chain which extend through tubes 10*a* formed integrally in seat 10, as shown in FIGS. 2 and 3 and described in U.S. Pat. No. 4,478,410. For purposes of this description, we will assume that the connector members 16 are chains whose end links 16*a* (FIG. 2) project slightly from the opposite ends of seat 10 and are connected to hangers 22 at the ends of the seat.

Preferably, hangers 22 are inverted generally V-shaped wire members whose arms 22*a* terminate in hooks 22*b* which are hooked through the end links 16*a* of the associated chain 16 as shown in FIGS. 2 and 3.

The upper ends of the suspension chains 12 are connected by standard S-hooks 24 to a pair of hanger bolts 26 whose shanks extend through appropriate openings in the crossbar 14 and are secured there by nuts 28 screwed onto the upper ends of the hanger bolts. Thus, the swing is free to swing about pivot points at the hanger bolts. If desired, bearings (not shown) may be provided in the upper loops of the S-hooks to minimize wear on those connections due to the motion of the swing. Preferably also, the suspension chains 12 are covered along their entire lengths by plastic sleeves 12*a* to provide good gripping surfaces for the occupant of the swing.

Surrounding each of the hanger hooks 22*b* and its connection to the associated chain 16 is a relating stiff connection guard 32. The guards are shown as being spherical. However, they could just as well be some other shape. Similar connection guards 32' surround the lower loops of the S-hooks 24 supporting the upper ends of the suspension chains 12.

As shown in FIGS. 2 and 3, each illustrated connection guard 32 comprises a pair of more or less mirror image, generally hemispherical shells 32*a* and 32*b*. Actually, as best seen in FIG. 2, shell 32*b* constitutes a slightly larger section of the sphere made up by the two shells 32*a* and 32*b*. The shells are preferably molded of a relating stiff rugged, weather-resistant plastic material such as rubber, polyethylene or styrene. However, they could just as well be formed out of metal or wood. Formed at the inside each shell 32*a* is a hollow, and radially extending pedestal 34 which extends from the bottom of the shell more or less to the diametric plane defined by the edge of the shell. A hole 36 in the outer wall of the shell extends to the interior of the pedestal and a colinear hole 38 present in the top wall of the pedestal is sized to receive the shank of a threaded fastener 42 inserted into the pedestal through opening 36.

Shell 32*b* of each guard 32 is similar to shell 32*a* in that it has an interior, radially extending, hollow pedestal 44. However, pedestal 44 is somewhat smaller in diameter than pedestal 34 and it does not extend all the way to the plane defined by the edge of shell 32*b*. A hole 46 in shell 32*b* extends through the outer wall of that shell into pedestal 44 and a small colinear hole 48 is present at the top of that pedestal.

As shown in FIGS. 2 and 3, at least two slots 52 and 54 extend into the sides of shell 32*b* from the edge of that shell. These slots are spaced around the circumference of the shell so that when that shell is positioned adjacent to the hanger hook 22*a*, the slot 52 is in position to receive the adjacent arm 22*a* of hanger 22 and slot 54 is in position to provide clearance for the chain link 16*a* connected to that hook 22*a*.

As shown in the drawing figures, when unoccupied, the swing seat 10 ends hang down from the hanger arms 22*a* at an angle of about 135°; therefore, the slots 52 and 54 are spaced around the axis of shell 32*b* at that same angle. It should be understood, however, that that angle may vary, depending upon the amount of sag in seat 10, from 90° to 180°.

With these slots, the shell 32*b* can be positioned snugly against the side of hook 22*b* so that the shell pedestal 44 projects through the eye of that hook as shown in FIG. 3 and at the right hand side of FIG. 2. Then, the other shell 32*a* can be positioned against the opposite side of that hook 22*b* so that its edge engages the edge of shell 32*b*. Preferably, the engaging edges or rims of the two shells are notched so as to interfit to maintain the alignment of the shells. Thus, in the illustrated embodiment of the invention, the edge of shell 32*a* has an exterior circumferential notch 56*a* and shell 32*b* has an interior circumferential notch 56*b*. Also, it may be necessary to provide a slot 58 in the wall of shell 32*a* directly opposite the slot 54 in shell 32*b* to provide additional clearance for the chain link 16*a* when the two shells are brought together as shown at the right hand side of FIG. 2.

When the shells are mated as shown, the threaded fastener 42 may be inserted through opening 36 in shell 32*a* and through the smaller opening 38 in that shell's pedestal 34 so that the fastener projects through the hanger hook 22*b* and extends into the hole 48 in pedestal 44 of shell 32*b*. When the fastener is turned down into that last hole, it taps threads into the wall of that hole and fastens the two shells tightly together, as depicted at the right hand side of FIG. 2.

When the two shells 32*a* and 32*b* are secured together, they completely enclose the associated hanger hook 22*b* and the end of chain link 16*a* connected to that hook. Therefore, it is impossible for a child using the swing to insert his or her fingers into that connection and possibly being injured because of that action.

It is also an important feature of the invention that the guard 32 at each hanger hook 22*b* prevents the chain link 16*a* connected to that hook from becoming disconnected because that hook was not closed completely during assembly of the swing.

Instead of using a fastener to secure these two shells together, one of the pedestals, e.g., pedestal 44 may be formed with a male snap fastener member or barb at its free end as shown in phantom 44*a* at the left side of FIG. 2. When the two shells are brought together, barb 44*a* is arranged to plug into hole 38 in pedestal 34. This connection, as opposed to fastener 42, tends to be permanent.

More particularly, and as best seen in FIG. 3, the relative angular position of each hook arm 22*a* and the chain link 16*a* connected to that arm is substantially fixed at about 135° by the slots 52 and 54, 58 formed in the guard 32 engaged to that hook arm. Moreover, any appreciable lengthwise motion of that link is prevented by the pedestals 34,44 forming the axle that extends through the eye of the hook. Accordingly, there is little or no likelihood of the chain link 16*a* finding its way to the mouth of hook 22*b* even during the most violent movements of the swing.

Resultantly, even if a gap G should be present at the mouth of hook 22*b* as shown in FIG. 3 which is large enough to permit the escape of chain link 16*a*, that link will be unable to slide along the hook far enough to reach that gap.

It should be mentioned that while the connection guard 32 more or less fixes the relative position of the hanger arm 22*a* and the chain link 16*a* hooked to that arm, the guard does permit some tilting and rotation of the chain link 16*a* about the longitudinal axis of chain 16 because the slots 54, 58 are somewhat oversize and the guard shells 32*a* and 32*b* are free to rotate relative to one another about the common axis of the pedestals 34 and 44, i.e., about fastener 42.

In addition to providing protection from pinch points and preventing accidental release of chains 16 from their hangers 22 as described above, the guards, by virtue of their shape and placement, also add decoration to the swing. While the illustrated guards are spherical, they could just as well be square, elliptical, heart-shaped or given some other shape that would make them particularly pleasing to the eye. Also, the guards may be brightly colored or provided with a decorative surface coating as indicated by stippling 62 on the right hand guard 32 in FIG. 2. If desired, these colors may be coordinated with the colors of strap 10 and the chain sleeves 12*a* to enhance the overall ornamental appearance of the swing, which is desirable from a marketing standpoint.

The guards 32' at the tops of the suspension chains 12 are more or less the same as the guards 32. That is, each guard 32' comprises a pair of more or less mirror image hemispherical shells which engage opposite sides of the lower loop of the associated S-hook 24 and the chain link attached to that hook. In the case of guards 32', however, the notches 52 and 54, 58 in the guard shells are located diametrically opposite one another because the suspension chain 12 hangs down vertically from the S-hook 24. Thus, each guard 32' maintains a 180° angular alignment of the associated S-hook 24 and the claim link connected to that hook.

Each guard 32', being located directly opposite the upper loop of an S-hook 24 also closes any gap present in the upper loop of that S-hook so that that loop cannot detach accidentally from the associated hanger bolt 26 when the swing is in motion.

It will be appreciated from the foregoing that the guards 32 and 32' greatly increase the marketability of a children's swing because they make the swing safer to use and improve the ornamental appearance of the swing. Yet, being composed primarily of inexpensive molded parts, the guards are relatively inexpensive to make in quantity so they do not add appreciably to the overall cost of the swing. Furthermore, since only threaded fasteners are needed to attach the guards to the swing, they can be installed easily by a customer when the swing is purchased; they can even be retrofitted to existing swings.

It will thus be seen that the objects set forth above, among those made apparent from the preceding description, are efficiently attained. Also, certain changes may be made in the above construction without departing from the scope of the invention. For example, similar guards can be applied to the ring bolts used to connect wooden swing seats to their suspension chains and to the connections of the swing described in the abovementioned U.S. Pat. No. 4,478,410. In the latter case, the guard may be sized and slotted to enclose the entire S-hook and its two connections to the two chains. Therefore, it is intended that all matter contained in the above description or shown in the accompanying drawings be interpreted as illustrative and not in a limiting sense.

It will also be understood that the following claims are intended to cover all of the generic and specific features of the invention described herein.

I claim:

1. A guard for a swing connection composed of a connector member having an eye and a hook which hooks through the eye, said guard comprising a dished shell having an edge defining a plane and an axis extending generally perpendicular to said plane;

at least two slots extending into said shell from said edge, said slots being angularly displaced about said axis so that a first slot can receive the hook and a second slot can receive the connector member enabling adjacent portions of the hook and connector member to be recessed into said shell;

a cover member for engagement to the edge of the shell so as to cover said adjacent recessed portions of the hook and connector member, and means for securing the cover member to the shell.

2. The guard defined in claim 1 wherein the connector member comprises a link of a chain.

3. The guard defined in claim 1 wherein said shell has an integral internal pedestal which extends along said axis toward said plane, and said securing means include a fastener which extends from said cover member and is fastened to said pedestal.

4. The guard defined in claim 3 wherein said shell is generally hemispherical, and said pedestal is generally cylindrical.

5. The guard defined in claim 1 wherein said first and second slots are located from about 90° to about 180° apart about said axis.

6. The guard defined in claim 1 and further including means defining a decorative feature on the exterior surface of said shell.

7. The guard defined in claim 1 wherein said cover member comprises a second shell which is generally a mirror image of said shell so that when the two shells are secured together edge to edge by the securing means, they form an enclosure that completely surrounds said adjacent recessed portions of the hook and connector member.

8. The guard defined in claim 7 wherein said shells have integral internal pedestals which extend toward one another along said axis to form an axle which extends through said hook.

9. The guard defined in claim 8 wherein the securing means comprise a fastener which extends from the pedestal of one shell through the hook and is fastened to the pedestal of the other shell.

10. The guard defined in claim 7 and further including means defining decorative features on the exterior surfaces of said shells.

11. The guard defined in claim 7 wherein the second shell has at least one edge slot opposite a slot in said shell so that the opposing slots in the two shells combine to form a single opening in said guard to accommodate one of said hook and said connector member.

12. The guard defined in claim 7 wherein opposing edges of said shells interfit to fix the relative position of said shells.

13. The guard defined in claim 1 wherein said hook is at the end of a swing seat hanger.

14. The guard defined in claim 1 wherein said hook is one loop of an S-hook, the other loop of which may contain a bearing.

15. A guard for a swing connection composed of a connector member having an eye and a hook which hooks through that eye, said guard comprising a pair of dished shells adapted to be positioned on opposite sides of the hook;

first and second edge slots in at least one of said shells, said edge slots being angularly spaced about the axis of said one shell from 90° to 180° so that when the shells are engaged to opposite sides of the hook, said slots provide clearance for and trap the connector member and hook, allowing the edges of said shells to engage one another forming an enclosure which completely encloses the adjacent portions of the connector member and hook, and means for fastening the shells-.together edge to edge.

16. The guard defined in claim 15 wherein the shells are generally hemispherical.

17. The guard defined in claim 15 and further including at least one edge slot in the other shell for positioning opposite one of the edge slots in said one shell.

18. The guard defined in claim 15 wherein said shells have decorative outer surfaces.

19. The guard defined in claim 15 wherein the shells have integral internal pedestals which form an axle when the shell are fastened together edge to edge.

20. The guard defined in claim 19 wherein the fastening means include a threaded fastener extending from the end of one pedestal and adapted to be turned down into the end of the other pedestal.

21. The guard defined in claim 19 wherein the fastening means include a male snap fastener member projecting from the end of one pedestal and adapted to be inserted into an opening at the end of the other pedestal.

* * * * *